US008869469B2

(12) United States Patent
Ludlow et al.

(10) Patent No.: US 8,869,469 B2
(45) Date of Patent: Oct. 28, 2014

(54) IN-GROUND SPA INSTALLATION

(75) Inventors: David J. Ludlow, Salt Lake City, UT (US); Marvin Hinckley Howell, Salt Lake City, UT (US)

(73) Assignee: Bullfrog International, L.C., Bluffdale, UT (US)

( * ) Notice: Subject to any disclaimer, the term of this patent is extended or adjusted under 35 U.S.C. 154(b) by 0 days.

(21) Appl. No.: 13/593,486

(22) Filed: Aug. 23, 2012

(65) Prior Publication Data

US 2013/0152297 A1 Jun. 20, 2013

Related U.S. Application Data

(63) Continuation-in-part of application No. 12/945,872, filed on Nov. 14, 2010, now abandoned.

(60) Provisional application No. 61/261,298, filed on Nov. 13, 2009.

(51) Int. Cl.
*E04B 1/00* (2006.01)
*E04H 4/00* (2006.01)

(52) U.S. Cl.
CPC ..... *E04H 4/0043* (2013.01)
USPC ..... 52/169.7; 52/270; 4/593; 4/506

(58) Field of Classification Search
USPC ..... 52/169.7, 270, 278, 279, 284, 584, 592, 52/593, 506; 4/584, 592, 593, 506
See application file for complete search history.

(56) References Cited

U.S. PATENT DOCUMENTS

| | | | | | |
|---|---|---|---|---|---|
| 4,124,907 | A * | 11/1978 | Laven | ..... | 52/169.7 |
| 5,713,085 | A * | 2/1998 | Enns | ..... | 4/506 |
| 5,727,264 | A * | 3/1998 | Craig et al. | ..... | 4/489 |
| 6,327,722 | B1 * | 12/2001 | Noble | ..... | 4/592 |
| 6,854,223 | B1 * | 2/2005 | Holland | ..... | 52/169.7 |
| 8,074,406 | B2 * | 12/2011 | Ksenych et al. | ..... | 52/169.7 |

* cited by examiner

*Primary Examiner* — William Gilbert
*Assistant Examiner* — Gisele Ford
(74) *Attorney, Agent, or Firm* — James Sonntag; Amy Fiene

(57) ABSTRACT

A system for providing an in-ground installation of a portable spa using a Spa Vault assembly.

15 Claims, 8 Drawing Sheets

IN-GROUND SPA INSTALLATION

CROSS REFERENCE TO RELATED APPLICATIONS

This application is a Continuation-in-part of U.S. Non-provisional patent application Ser. No. 12/945,872, filed 14 Nov. 2010, which claims priority from U.S. Provisional Patent Application 61/261,298, filed 13 Nov. 2009, both of which are hereby incorporated by reference.

BACKGROUND

Currently, a self contained spa can be installed as an in-ground spa by preparing the installation site with extensive modification and customized construction—an expensive and time consuming project requiring a contractor.

SUMMARY

The Spa Vault™ is assembled in an excavation to provide a cavity so that in the ground it provides a finished hole into which a pre-assembled spa can be lowered to provide an in-ground installed spa. This is accomplished without an extensive or customized construction requiring a contractor. By use of the Spa Vault, the assembly and installation can be accomplished by a consumer without specialized knowledge. Depending upon local codes, the only professional that might be involved is an electrician, who would be required in any event even if the spa were merely placed at ground level.

In an aspect, the Spa Vault is an assembled system that can be built to accommodate any size portable electric spa. A portable electric spa or portable spa is a self contained (integrated, stand-alone), electrically powered, system. These spas are generally engineered and fully insulated system that are essentially "plug and play". The Spa Vault provides a method to install a portable spa into the ground granting all the benefits of the portable spa without the drawbacks of the typical in-ground installation requirements. The Spa Vault allows for a "Do it Yourself" installation for a person with general skills.

The major components of the Spa Vault are made with conventional materials using conventional techniques. For example, the system can be fabricated mainly of formed galvanized metal sheets, that are fixed together using conventional fasteners.

An aspect is an assembly of a back wall, two side walls attached at first ends to either end of the back wall, two transition walls attached at first ends to a second end of the each of the side walls, and front wall attached to and extending between second ends of the transition walls. When assembled the spa vault is shaped to provide a cavity into which a portable spa can be placed, this is with spa walls near to the back wall and side walls, and spa corners near the joinders at the ends of the side walls.

To provide access to the utility or pump cabinet of the spa (containing spa serviceable spa equipment such as pumps, filters, electrical equipment and the like), the assembly of the transition walls and front walls provide sufficient space between the front wall and spa wall for a service well. The service well should be large enough to allow removal of any spa panels to open the pump cabinet and allow access to service or repair equipment in the cabinet.

Optionally corner pieces are provided at the joinders at the ends of the side walls. The corner pieces are near the corners of the spa have a curved profile that follows near the profile spa corners.

In an aspect, the walls are made as flat panels, but they may be other shapes. For example, the ends of one or more of the walls may be curved to follow the curve of spa corners (thereby eliminating the a need for corner pieces). In addition, any of the walls can be prejoined or fabricated as integral units. For example, the transition walls and the front wall may be fabricated together into one piece, or a side wall with its adjacent transition wall may be fabricated together as one piece. In either of these example, the joinder between the walls can be a smooth, seamless, or straight transition.

The Spa Vault assembly is dimensioned such that side walls, back walls, side wall joinders and corner pieces are near spa walls. By near is meant that these are closely spaced to spa walls, but with sufficient space to allow insertion of the spa into the hole provided by the walls, and allow backfilling of the space. Wit the exception of the service well, the provided cavity is generally the same same shape and dimensions of the spa for which it is designed, with allowance for insertion and backfilling.

Advantages of the spa vault,

Spa Vault is an easy "Do it yourself" type project.

Customizable look at installation

Rapid assembly and installation

Lower skill set required to install

Easy to assemble

Allows a portable spa to install in place of an in-ground spa

Installation of a completely self contained and hydraulically engineered spa

Ease of service for the equipment

Spa is easily removed

Spa Vault allows for the spa to be placed at ground level or partially above the ground Fully insulated by ground for energy efficiency

DETAILED DESCRIPTION

Figure 1:
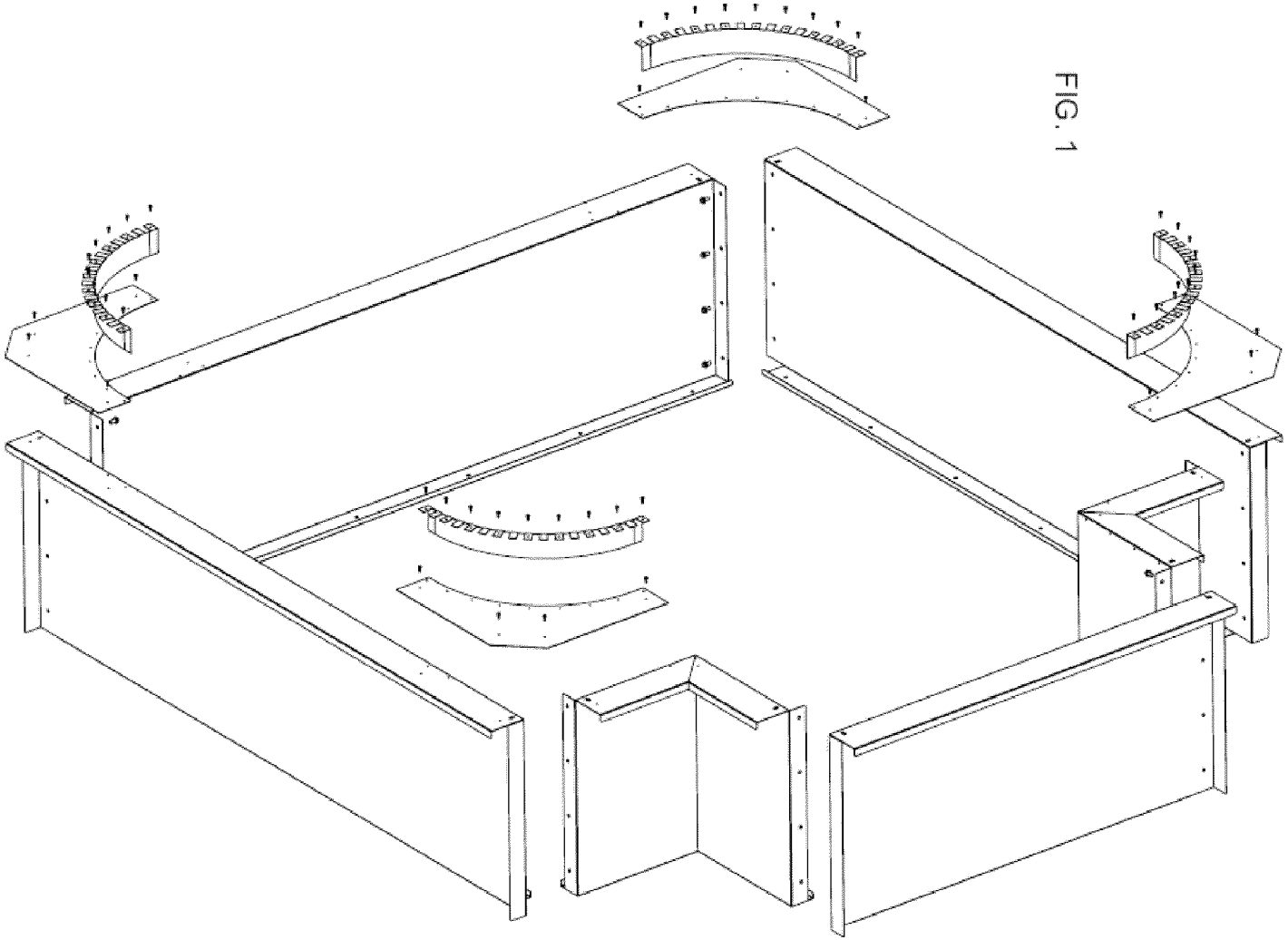
FIG. 1 is an exploded view of a Spa Vault.
Figure 2:
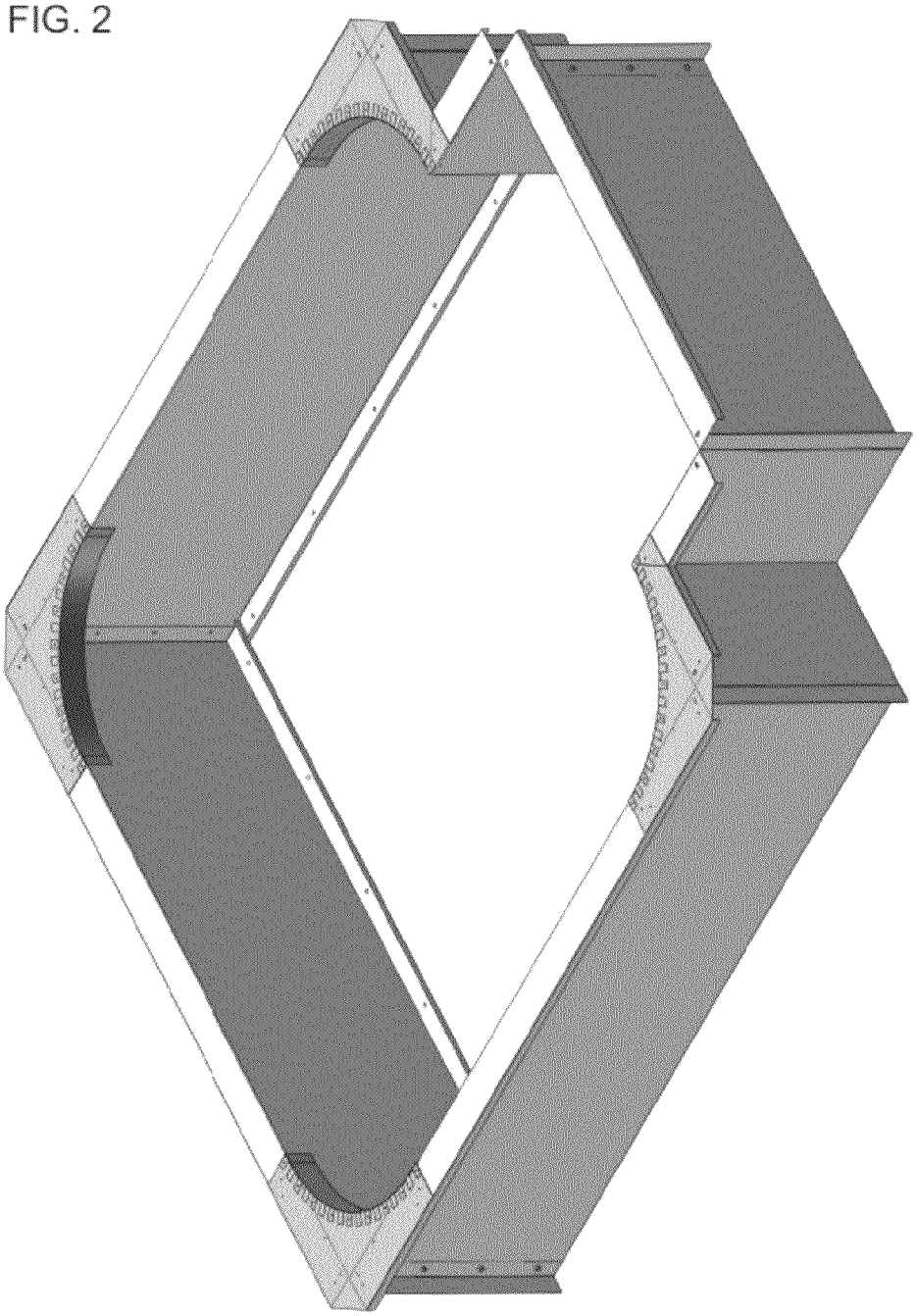
FIG. 2 is a perspective view of an assembled Spa Vault.

Referring to FIG. 1, and FIG. 2, the Spa Vault 11 has a front wall 13, two side walls 15, a back wall 17, two corner walls 19, four corner pieces 21, (each of which may formed from separate radius inserts 23, and corner plates 25). The spa vault is assembled to provide a finished cavity in the ground into which a conventional free-standing spa can be lowered, providing an in-ground installation. The assembled Spa Vault 11 is dimensioned to approximate the outer lateral dimensions of the spa, along with clearances to allow installation of the spa into the cavity.

The Spa Vault is also configured to provide a service well 27 (FIG. 2) when the spa is installed. The service well is to access to the equipment chamber (containing the pumps, and the like) and provide space for other functions, such as drains, filling system, auxiliary systems or customized components and add-ons.

Accordingly, the front wall 13 is attached to the side walls 15 with intervening corner or transition walls 19, which together are configured to provide this access or service well 27. The shape of the cavity or hole provided by the Spa Vault can be described as a main square or rectangle (corresponding to the shape of the spa) with an side rectangle extending from one side (for the service well). Corner or pieces 21 are provided at the corners of the main rectangle (corresponding with rounded corners of the spa) to provide a cavity opening with rounded corners.

In the below example, these corner pieces 21 include horizontal corner plates 25 and radius inserts 23 at the top of the spa wall. However, they may be of different construction, such as an integrated piece, or be in the form of curved corner insert walls that extend from the bottom of the cavity to its top between the side walls and attached back and corner walls, thus also providing the attachment between the side walls and adjacent back and corner walls.

Example

Figure 3B:
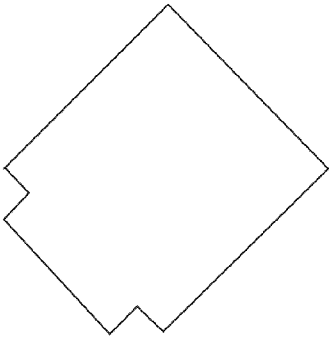
FIGS. 3A to 3P are exemplary images from an instruction manual for an exemplary Spa Vault installation.
Figure 3A:
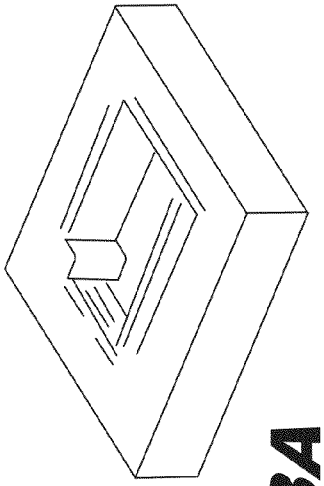
Figure 3D:
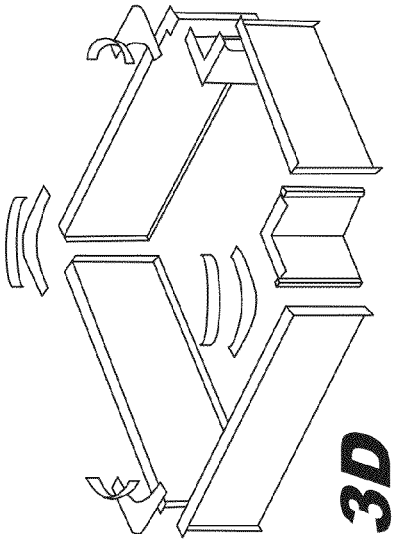
Figure 3C:
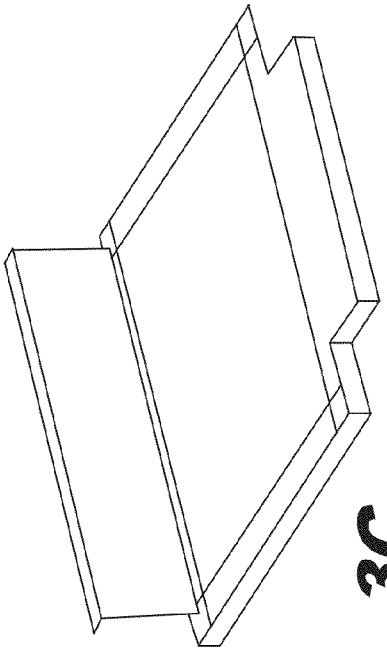
Figure 3F:
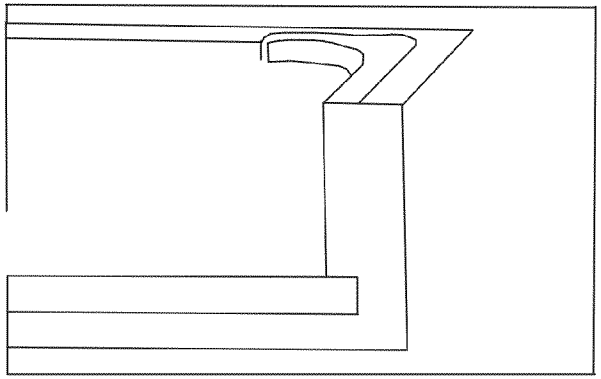
Figure 3H:
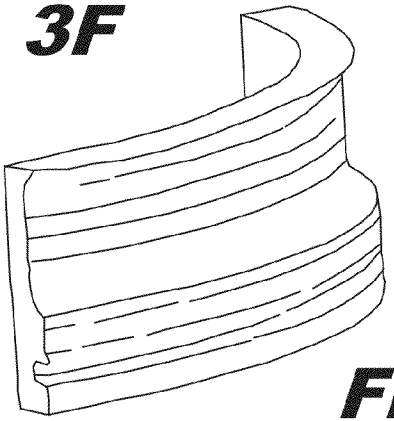
Figure 3E:
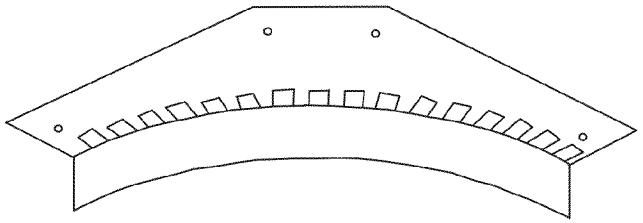
Figure 3G:
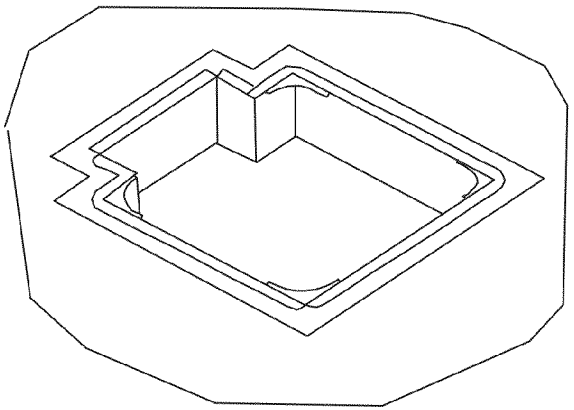
Figure 3J:
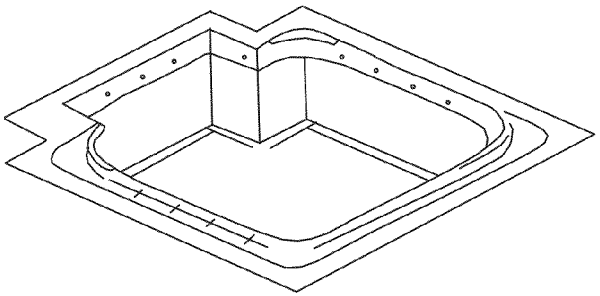
Figure 3L:
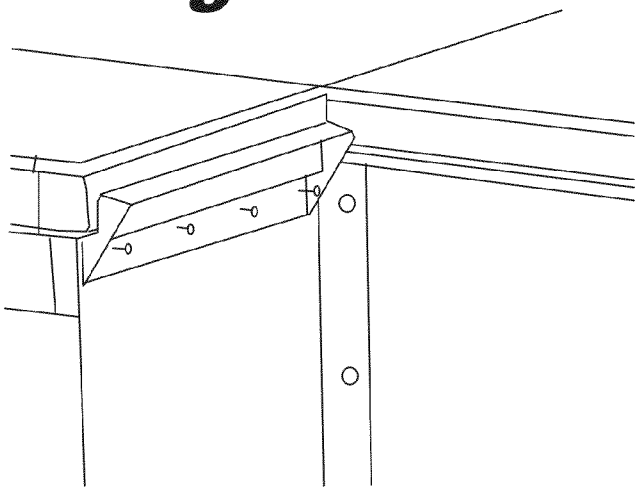
Figure 3I:
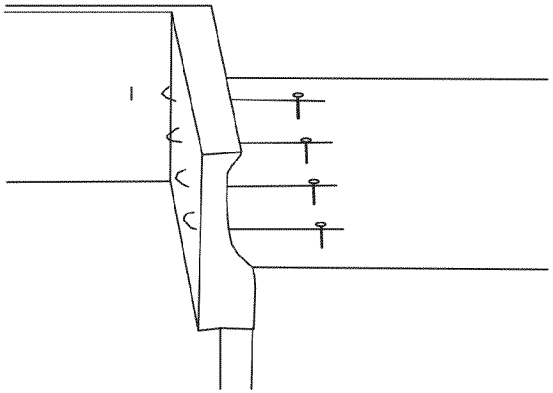
Figure 3K:
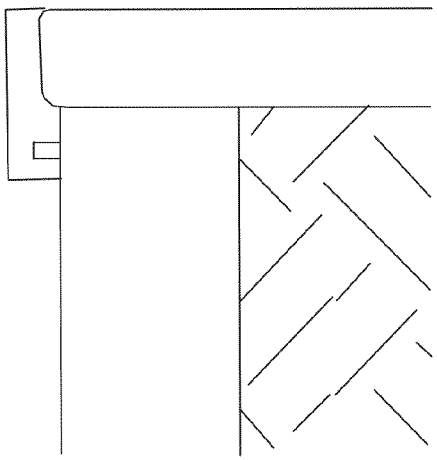
Figure 3N:
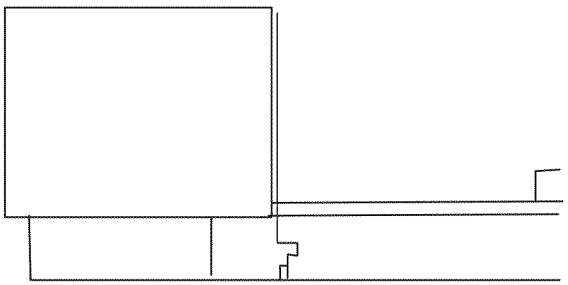
Figure 3P:
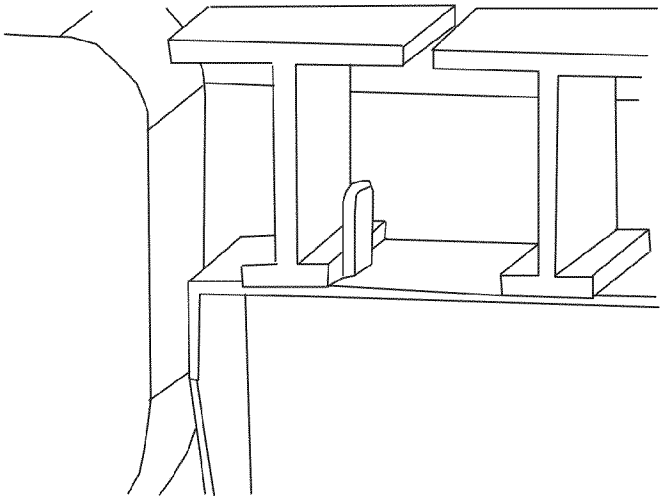

An exemplary installation is shown in FIGS. 3A to 3P.

In Step 1 and Step 2, (FIG. 3A) an excavation is made, and the electrical is roughed in.

In Step 3 and Step 4 the excavation is prepared for installation of the Spa Vault, providing also for a drain. In this example, a gravel base and concrete pad are installed (FIG. 3B). Alternate preparation is contemplated. A suitable installation provides a sufficient foundation to secure the Spa Vault walls (to withstand the backfilling and maintain the integrity of the excavation), provide sufficient drainage, and provide support for the spa after it is lowered in the spa vault and filled with water. Exemplary systems include platforms, footings or pilings of stone, concrete, polymeric materials, treated wood, and the like, with base materials or fill materials of gravel, sand, or the like.

In Step 5, the Spa Vault comprising spa walls, and corner pieces (corner plates and radius inserts) is assembled and installed. (FIG. 3C and FIG. 3D) The walls, and corner pieces may be fabricated, molded or cast and of the same or different material. They can be for example, metal such as steel that is galvanized, plated, coated or otherwise treated to inhibit corrosion or stainless steel, composite metal wood construction, engineering plastics, or polymer-fiber composites, and the like. The walls have structure and/or fasteners for attachment to indicated walls at the ends, attachment of the corner plates, and attachment to the base or foundation. In the example, the wall are formed from formed sheet metal, with flanges and holes for fasteners.

Attachment of the walls to one another and to the base or foundation can be by any suitable means, including flanges on the walls, with suitable attachments fixtures, such as nuts and bolts. Other attachment systems are contemplated, such those using one or more of adhesives, attachment clips, screws, nuts and bolts, slots or appendages attached to the walls, welding, and the like. A suitable system, such in the example, is designed to be used by an untrained consumer.

In the example, the corner pieces (FIG. 3E), which are designed and dimensioned to correspond to and fit around the corners of an inserted spa, are provided as separate corner plates and radius inserts. The corner pieces may be provided as an integral piece that may be, for example, fabricated, molded or cast. The corner pieces can be attached by any suitable system.

In Step 6, the gap between the Spa Vault walls and the edges of the excavation are backfilled. Any suitable backfilling or other method for filling the gap is contemplated, for example, backing filling with sand using water to wash the sand tightly around the Spa Vault. If concrete is installed over the backfill, the backfill method should be suitable for such an installation. In the example is shown the use of filter fabric the is placed over the exposed gravel and overlapping the concrete pad. (FIG. 3F). At the end of this step, the Spa Vault is ready for construction of the deck. (FIG. 3G)

In Step 7 a deck is constructed. In the example, the deck is concrete, but any suitable construction is contemplated. Suitable constructions include, but are not limited to, concrete, wood, paving, tile, stone, polymeric materials, ceramics, used alone or in combination.

In the example, Stegmeier "Cantilever Forms" are used for form a barrier around the SpaVault cavity (FIG. 3J). A bending tape (FIG. 3H) is used at the corners, The forms are secured to the top flange of the spa-vault wall with self tapping screws screwed into the flange, with tie wire between the screws and the forms. (FIG. 3I) The finished form is shown in FIG. 3J.

Concrete is poured into the form in a conventional manner, the concrete surface is finished, and the forms are removed. A cross-section of the SpaVault wall, with installed forms and concrete deck is shown in FIG. 3K.

In Step 8, structure is added to the corner walls to provide support to for a removable access grate, which covers and provides access to the service well. (FIG. 3L) The supports may be integrally built into the corner walls or be separate as in this example, and be of the same or different material of the corner walls.

Figure 3M:
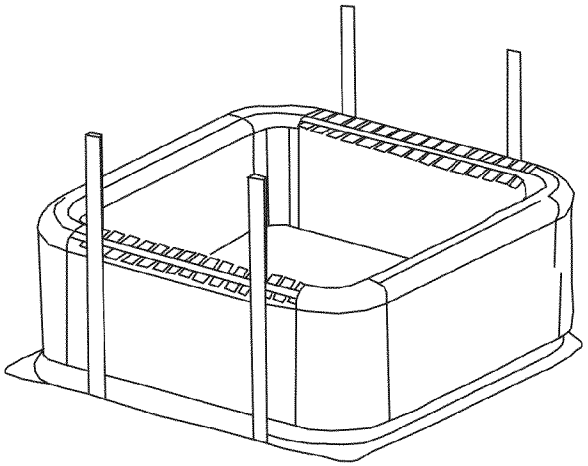

In Step 9, referring to FIG. 3M, the spa vault is ready for installation of the spa, which is installed by lowering on straps into the Spa Vault. The straps are then removed. Other systems are contemplated, and may include lifting fixtures built into the spa or Spa Vault.

In Step 10 the electrical connections are made to the spa (FIG. 3N, which is a partial view of the front and service well).

Figure 3O:
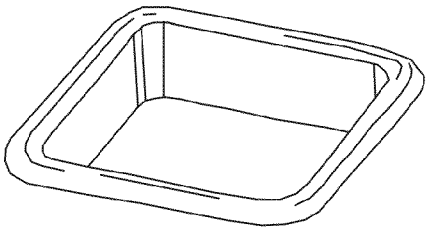

In step 11 the access grate is installed to cover the service well. (FIG. 3O) As shown in FIG. 3P, the grate can be supported on the grate support and aligned with alignment tabs that abut a foot on the access grate, Depending upon the spa model. Other utilities or accessories may also be connected or installed in the service well, such as audio/video feeds, customized plumbing for filling and draining, customized water treatment systems, and the like.

In the example, the excavation is deep enough so the when the deck installed, a bather steps from the deck down into the sap. Alternately, the excavation is less deep, so that the deck includes a retaining wall, or step that extends up to the top of the Spa Vault wall. In another alternate embodiment, a portion of the finished portable spa wall can partially extend above the deck when installed in the cavity, with the deck extending up to near the spa wall.

Because portable spas may vary in dimensions, such as height and length, the walls of the Spa Vault may be adaptable to conform to different dimensions. This capability allows multiple spas to be used in conjunction with a single Spa Vault.

Figure 4:
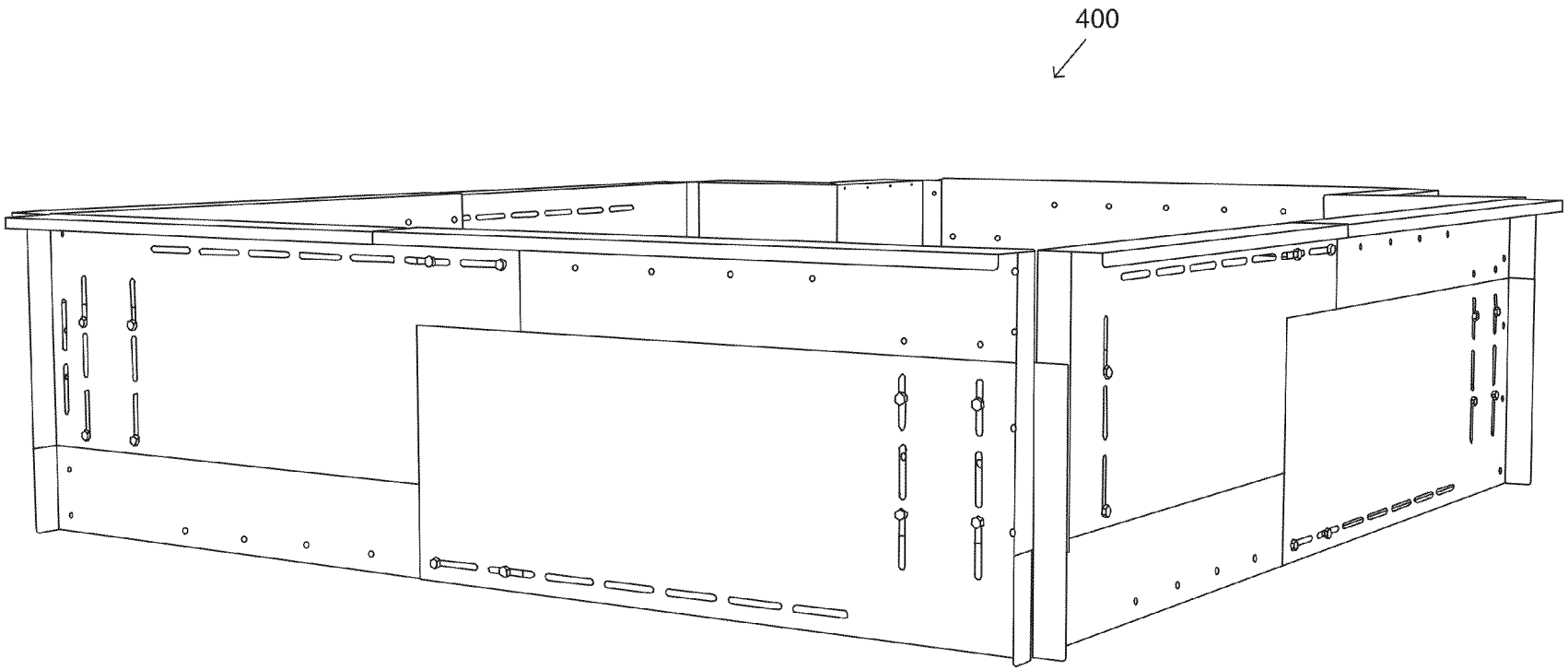
FIG. 4 is a perspective view of a Spa Vault with vertical and horizontal expanding walls.

Turning to FIG. 4, a perspective view of a spa vault 400 is shown with walls comprised of overlaying panels that can be adjusted and positioned in both a vertical and horizontal manner. Embodiments may include walls that are expanded by a series of panels. For example, a panel may slide relative to a wall until a desired position is achieved, and then the panel may be secured to the wall at the desired position. This effectively expands or contracts the wall to achieve a desired size. Thus the walls provide versatility to be able to handle new and uniquely sized spas.

Figure 5:
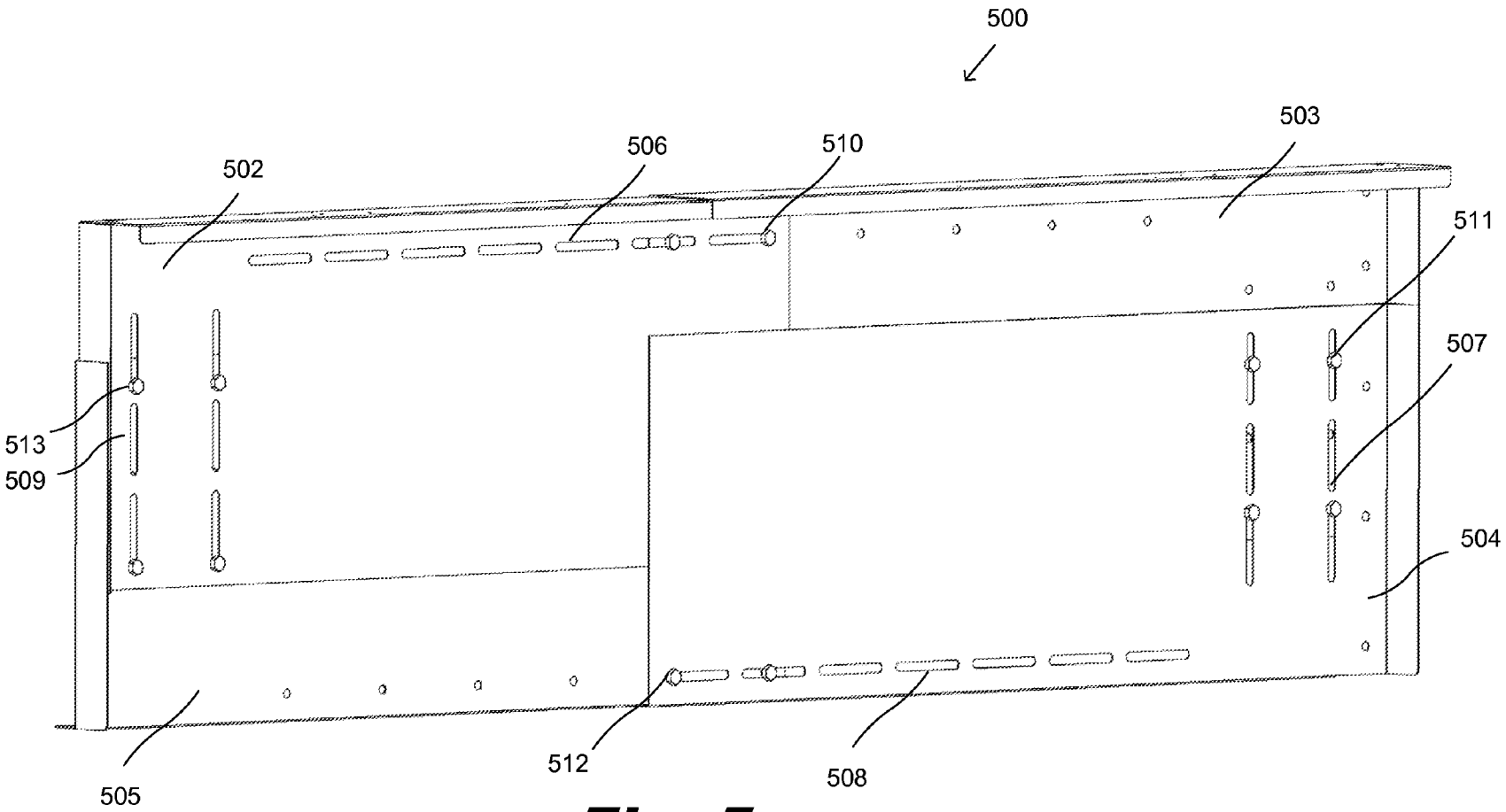
FIG. 5 is a front view of a single wall of a Spa Vault that may expand in a horizontal and vertical manner.

Turning to FIG. 5, a single wall 500 of a Spa Vault is shown, comprising panels 502-505; anchor sets 510-513; and slot sets 506-509. For vertical expansion and contraction, panels 502 and 503 may slide in a vertical direction relative to panels 504 and 505. For horizontal expansion and contraction, panels 504 and 503 slide in a horizontal direction relative to panels 505 and 502. Anchor sets 510-513 each comprise a series of anchors that may be used to connect or fasten their respective panels and slots. Slot sets 506-509 each comprise a series of slots that provide a means to restrict expansion of the panels to a horizontal and vertical direction.

In embodiments, one panel may comprise a series of holes that are evenly spaced apart. Another panel may comprise a series of slots such that when the panels are overlaid, the holes and slots may be aligned. The slots may extend in the horizontal and vertical directions. In this manner, a horizontal movement of the slotted panel in relation to the holed panel allows the panel to effectively expand the wall in the horizontal direction. This expansion may be secured by any suitable fastening system, such as one of or combination of fastener, adhesive, anchor, rivet, staple, nut, or screw that attaches or connects the slotted panel to the holed panel. Similarly, a vertical movement of the slotted panel in relation to the holed panel allows the panel to effectively expand the wall in the vertical direction.

If smaller sized walls are desired, contraction of the walls may occur by moving the panels in the opposite horizontal and vertical directions as described, or in other words, moving the panels inward relative to the overall wall formed by the rest of the panels.

Embodiments include other types of expansion walls. For example, instead of panels, the wall may have a slot with an interior panel that fits within the slot and that slides outwardly relative to the wall and thus allows horizontal expansion. Another slot may provide another interior panel that slides outwardly to allow vertical expansion. The interior panels may be accordion-like such that the interior panels are bent within the slot and then straighten to form a flat panel when exposed outside the slot.

Also, panels may not be restricted to movement in relation to the wall. Panels of various sizes and shapes may be bolted or otherwise fastened or secured to the wall to obtain desired dimensions of a wall. Thus, a wall may be used with no panels or with any number of various sized and shaped panels. This is advantageous because it allows the spa vault to be used with new designs and shapes of spas.

What is claimed is:

1. An assembly comprising:

a back wall;

two side walls, each with a first end attached to an end of the back wall, forming back wall/side wall attachments;

two transition walls, each transition wall comprising two generally perpendicular walls joined together, each transition wall attached at first ends to second ends of the side walls, forming transition wall/side wall attachments;

a front wall attached to and extending between second ends of the transition walls, forming front wall/transition wall attachments;

the back wall, side walls, transition walls, and front wall forming an assembly of vertically disposed walls that define a cavity portion dimensioned for placement of a portable, unsupported spa and a component portion for spa-related components and an access opening atop the component portion; and corner pieces at the back wall/side wall attachments and the transition wall/side wall attachments, the corner pieces having spa-like contours generally conforming to rounded corners of the portable spa;

wherein the corner pieces comprise corner pieces that are horizontally disposed along the top of the back wall/side wall attachments and the transition wall/side wall attachments, and vertically disposed along the back wall/side wall attachments and the transition wall/side wall attachments.

2. The assembly of claim 1, wherein one or more of the back wall, side walls, transition walls and front wall comprise multiple overlapping panels adjustably connected with facings slidable relative to each other in parallel planes to be extended in a horizontal or vertical direction.

3. The assembly of claim 1, wherein the multiple panels are restricted by an alignment member to horizontal or vertical movement and positioning in relation to each other.

4. The assembly of claim 1, wherein the corner pieces comprise corner plates that are horizontally disposed along the top of the back wall/side wall attachments and the transition wall/side wall attachments, and radius inserts that are vertically disposed along the back wall/side wall attachments and the transition wall/side wall attachments.

5. An assembly comprising:

a back wall;

two side walls, each with a first end attached to an end of the back wall, forming back wall/side wall attachments;

two transition walls, each transition wall comprising two generally perpendicular walls joined together, each transition wall attached at first ends to second ends of the side walls, forming transition wall/side wall attachments;

a front wall attached to and extending between second ends of the transition walls, forming front wall/transition wall attachments;

the back wall, side walls, transition walls, and front wall forming an assembly of vertically disposed walls and enclosing a cavity dimensioned to conform to and enclose a portable spa with a component portion for spa-related components and for access and service of spa-related elements;

corner pieces at the back wall/side wall attachments and the transition wall/side wall attachments, the corner pieces having spa-like contours generally conforming to rounded corners of the portable spa;

wherein the corner pieces comprise corner plates that are horizontally disposed along the top of the back wall/side wall attachments and the transition wall/side wall attachments, and radius inserts that are vertically disposed along the back wall/side wall attachments and the transition wall/side wall attachments, and fasteners that attach the corner plates and the radius inserts to each other and to the back wall/side wall attachments and the transition wall/side wall attachments.

6. The assembly of claim 5, additionally comprising cantilever forms disposed along an upper interior edge of the cavity to form a barrier around the cavity.

7. The assembly of claim 5, additionally comprising a removable access grate that covers the component portion.

8. The assembly of claim 7, additionally comprising a grate support that is vertically disposed within the component cavity and which supports the access grate.

9. The assembly of claim 8, additionally comprising an alignment tab that extends inwardly from one of the walls and that is configured to provide alignment of the access grate.

10. The assembly of claim 5, additionally comprising bending tape along the spa-like contours of the radius inserts.

11. The assembly of claim 5, additionally comprising removable straps for lowering and raising the wall assembly.

12. The assembly of claim 5, additionally comprising a lifting fixture that is built in to the wall assembly and which can be used for lowering and raising the assembly.

13. The assembly of claim 5 additionally comprising an attachment member that secures the first and second set of walls and free wall ends to surroundings, wherein the first and second set of walls and free wall ends may withstand lateral pressure from backfill material and maintain the integrity of the first and second cavity portions.

14. An assembly comprising:

a first set of walls attached at ends vertically, the walls defining a cavity portion with lateral dimensions in conformity with lateral dimensions of a portable spa, with an opening between two free wall ends and located to oppose access in the portable spa to spa-related components;

a second set of walls attached at ends and partially forming a second cavity portion, with two ends attached to the two free ends of the first set of walls such that the first cavity portion is joined with the second cavity portion, the second cavity portion forming an enclosure around spa-related components with an access opening atop the second cavity portion; and a portable spa and spa attachments, wherein the portable spa and spa attachments are structurally self-supportive independent of the first and second set of walls, and wherein the spa attachment parts connect to the portable spa and pass through the opening between two free wall ends into the second cavity portion.

15. The assembly of claim 14 additionally comprising an attachment member that secures the first and second set of walls to surroundings, wherein the first and second set of walls may withstand lateral pressure from backfill material and maintain the integrity of the first and second cavity portions.

* * * * *